US007208458B2

(12) United States Patent
Borchers et al.

(10) Patent No.: US 7,208,458 B2
(45) Date of Patent: Apr. 24, 2007

(54) SURFACTANT COMPOSITION COMPRISING FATTY ALCOHOL ALKOXYLATES AND AMORPHOUS SILICA

(75) Inventors: Georg Borchers, Bad Nauheim (DE); Manfred Schreiber, Frankfurt am Main (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 0 days.

(21) Appl. No.: 10/951,127

(22) Filed: Sep. 27, 2004

(65) Prior Publication Data

US 2005/0107280 A1 May 19, 2005

(30) Foreign Application Priority Data

Sep. 27, 2003 (DE) ..... 103 44 938

(51) Int. Cl.
*C11D 1/72* (2006.01)
*C11D 3/08* (2006.01)

(52) U.S. Cl. ..... 510/356; 510/276; 510/289; 510/444; 510/445; 510/460; 510/511

(58) Field of Classification Search ..... 510/216, 510/289, 356, 444, 445, 460, 511, 276
See application file for complete search history.

(56) References Cited

U.S. PATENT DOCUMENTS

| | | | | |
|---|---|---|---|---|
| 4,615,814 | A * | 10/1986 | Winetzky | 510/308 |
| 5,332,518 | A * | 7/1994 | Kuroda et al. | 510/309 |
| 5,427,711 | A * | 6/1995 | Sakaguchi et al. | 510/376 |
| 5,458,799 | A | 10/1995 | Flower | |
| 5,468,516 | A * | 11/1995 | Yamashita et al. | 510/441 |
| 5,496,486 | A * | 3/1996 | Staley | 510/441 |
| 5,529,715 | A * | 6/1996 | Kuroda et al. | 510/349 |
| 5,705,473 | A * | 1/1998 | Kuroda et al. | 510/441 |
| 5,834,414 | A * | 11/1998 | Sowle et al. | 510/379 |
| 5,849,105 | A * | 12/1998 | Massaux et al. | 134/29 |
| 6,008,174 | A * | 12/1999 | Brouwer et al. | 510/276 |
| 6,030,937 | A | 2/2000 | Kruse et al. | |
| 6,177,397 | B1 * | 1/2001 | Staley | 510/444 |
| 6,369,020 | B1 * | 4/2002 | Kohlus et al. | 510/438 |
| 6,645,931 | B1 * | 11/2003 | Yanagisawa et al. | 510/446 |
| 2002/0064854 | A1 * | 5/2002 | Takaiwa et al. | 435/220 |

FOREIGN PATENT DOCUMENTS

| | | |
|---|---|---|
| CA | 2308932 | 11/2000 |
| DE | 19601841 | 7/1997 |
| DE | 10008815 | 8/2001 |
| EP | 1347037 | 9/2003 |
| WO | WO 97/03165 | 1/1997 |

OTHER PUBLICATIONS

Abstract for DE 19601841, Jul. 24, 1997.
Abstract for DE 10008815, Aug. 30, 2001.
Abstract for EP 1347037, Sep. 24, 2003.

* cited by examiner

*Primary Examiner*—Charles Boyer
(74) *Attorney, Agent, or Firm*—Richard P. Silverman

(57) ABSTRACT

Surfactant compounds are claimed which consists essentially of a) fatty alcohol alkoxylates, b) amorphous silica, c) a carrier material and optionally d) an assistant.

9 Claims, No Drawings

SURFACTANT COMPOSITION COMPRISING FATTY ALCOHOL ALKOXYLATES AND AMORPHOUS SILICA

The invention relates to compounds comprising fatty alcohol alkoxylates, to a process for their preparation, and their use as surfactants.

Highly compressed or highly concentrated detergent powders, pellets or tablets constitute a significant proportion of the commercially available detergents. Fatty alcohol alkoxylates from the group of the nonionic surfactants are usually viscous to pasty substances which have to be converted to granule form for use in solid compositions.

The literature describes numerous processes by which surfactant granules can be prepared. DE 199 23 627 describes a process for preparing surfactant granules comprising nonionic surfactants, especially alkoxylated fatty alcohols and further detergent constituents, which comprises granulating liquid and solid constituents in the presence of polyalkylene glycol. In WO 97/03165, a mixture of alkoxylated fatty alcohol and an alkyl oligoglycoside is granulated in the presence of zeolites and/or waterglasses.

However, the granulation of fatty alcohol alkoxylates, especially at high surfactant contents, generally leads to tacky products and the compounds correspondingly only have restricted flowability. A further problem is the worsened solubility of the relatively highly compacted particles.

It is therefore an object of the present invention to provide fatty alcohol alkoxyl compounds having good and constant solubilities and good flowability even under thermal stress.

It has been found that, surprisingly, mixing of fatty alcohol alkoxylate, amorphous silica, a support material, more preferably a water-soluble support material and optionally further assistants, subsequent moistening of the mixture with water, possible granulation of the mixture and final drying provides free-flowing compounds having good solubility.

In the context of the invention, a compound refers to a solid formulation of an otherwise liquid to pasty surfactant. It may be in the form of granules or be present as a powder.

The invention provides surfactant compounds which consists substantially of a) fatty alcohol alkoxylates,
b) amorphous silica,
c) a carrier material and optionally
d) optionally customary assistants, and a process for preparing these surfactant compounds and their use as surfactants.

The inventive surfactant compounds comprise fatty alcohol alkoxylates, and the alkoxylate moiety consists of ethylene oxide (EO), propylene oxide (PO) or butylene oxide (BO) units or mixtures thereof. The alkoxylate moiety may also be present in the form of ethylene oxide/propylene oxide block copolymer. Fatty alcohol oxyalkylates in the context of the invention are also polyglycerolated fatty alcohols. Particular preference is given to ethoxylated fatty alcohols, preferably primary alcohols having preferably from 8 to 22 carbon atoms, for example coconut, palm fat, palm kernel, tallow fat, lauryl, stearyl or oleyl alcohol, and preferably from 1 to 80 EO units per mole of alcohol, and the alcohol radical is linear or may preferably be methyl-branched in the 2-position, or contains linear and methyl-branched radicals in a mixture, as is typically the case in oxo alcohol radicals. The preferred ethoxylated alcohols include, for example, $C_{11}$ alcohols having 3, 5, 7, 8 and 11 EO units, ($C_{12}$–$C_{15}$) alcohols having 3, 6, 7, 8, 10 and 13 EO units, ($C_{14}$–$C_{15}$) alcohols having 4, 7 and 8 EO units, ($C_{16}$–$C_{18}$) alcohols having 8, 11, 15, 20, 25, 50 and 80 EO units and mixtures thereof. The degrees of ethoxylation specified constitute statistical averages which may be an integer or a fraction for a specific product.

It is also possible to use fatty alcohol-EO/PO adducts, for example the ®Genapol types 3970, 2909 and 2822 from Clariant GmbH.

Additionally, the inventive surfactant compounds may also comprise polyethoxylated, polypropoxylated, polybutoxylated and polyglycerolated fatty acid alkyl esters, polyethyloxylated esters of sorbitol, polyethoxylated or polyhydroxy fatty acid amides, preferably those of the formula $R_2$—CO—N($R_3$)—Z in which $R_2$CO is an aliphatic acyl radical having from 6 to 22 carbon atoms, $R_3$ is hydrogen, an alkyl or hydroxyalkyl radical having from 1 to 4 carbon atoms and Z is a linear or branched polyhydroxyalkyl radical having from 3 to 10 carbon atoms and from 3 to 10 hydroxyl groups, but also alkylglycosides of the general formula RO(G)X where R is a primary straight-chain or methyl-branched, especially 2-methyl-branched, aliphatic radical having from 8 to 22, preferably from 12 to 18, carbon atoms, and G is a glycose unit having 5 or 6 carbon atoms, preferably glucose. The degree of oligomerization x which reports the distribution of monoglycosides and oligoglycosides is preferably a number between 1 and 10; x is more preferably between 1.2 and 1.4.

The amount of fatty alcohol alkoxylates in the inventive surfactant compounds may be from 20 to 80% by weight, preferably from 30 to 60% by weight, more preferably from 40 to 55% by weight, based on the finished surfactant compound.

The inventive surfactant compounds comprise, as component b), amorphous silicas whose internal surface area is preferably in the range from 10 $m^2/g$ to 500 $m^2/g$, especially from 100 $m^2/g$ to 450 $m^2/g$. Suitable silicas are those which have been prepared by the thermal process (flame hydrolysis of $SiCl_4$) (known as pyrogenic silicas), and also silicas prepared by wet processes (known as precipitated silicas). They may also be prepared by the action of mineral acids on waterglass.

The amount of amorphous silica may be from 5 to 40% by weight, preferably from 10 to 30% by weight, more preferably from 15 to 25% by weight, based on the finished surfactant compound.

In a preferred embodiment, the weight ratio of fatty alcohol alkoxylate to amorphous silica may be in the range from 1:1 to 4:1, preferably from 1.5:1 to 3:1, more preferably from 2:1 to 2.8:1.

Suitable carrier materials are, for example, silicates, clays, carbonates, phosphates, sulfates and citrates. Clays are naturally occurring crystalline or amorphous silicates of aluminum, iron, magnesium, calcium, potassium and sodium, for example kaolin, talc, pyrophyllite, attapulgite, sepiolite, saponites, hectorites, smectites such as montmorillonite especially bentonites, bauxite and zeolite. Particularly suitable are crystalline sheetlike alkali metal silicates of the formula $MM'Si_xO_{2x-1}$ $yH_2O$ (M,M'=Na, K, H, x=1.9–23, y=0–25), preferably sodium silicates, for example the types obtainable under the trade names SKS-6 and Nabion 15.

Equally suitable are type A and P zeolites, and also bentonites, as commercially available under the designation Laundrosil® DGA, Laundrosil® EX 0242 or Ikomont® CA white. Sheet silicates may also be used in acid-modified form, as available in the commercial products Tonsil® EX 519, Tonsil Optimum 210 FF, Tonsil Standard 310 FF and 314 FF, and also Opazil® SO from Südchemie.

Further suitable carrier materials are alkali metal phosphates which may be present in the form of their alkaline, neutral or acidic sodium or potassium salts. Examples thereof are trisodium phosphate, tetrasodium diphosphate, disodium dihydrogen diphosphate, pentasodium triphosphate, known as sodium hexametaphosphate, oligomeric trisodium phosphate having degrees of oligomerization of from 5 to 1000, especially from 5 to 50, and also mixtures of sodium and potassium salts.

Useful organic carrier materials are, for example, the carboxylic acids preferably used in the form of their sodium salts, such as citric acid and nitriloacetate (NTA), ethylenediaminetetraacetic acid. In a similar manner, polymeric carboxylates and their salts may also be used. These include, for example, the salts of homopolymeric or copolymeric polyacrylates, polymethacrylates and especially copolymers of acrylic acid with maleic acid, preferably those composed of from 50% to 10% maleic acid, polyaspartic acid and also polyvinylpyrrolidone and urethanes. The relative molecular mass of the homopolymers is generally between 1000 and 100 000, that of the copolymers between 2000 and 200 000, preferably from 50 000 to 120 000, based on the free acid. Especially suitable are also water-soluble polyacrylates which are crosslinked, for example, with about 1% of a polyallyl ether of sucrose and which have a relative molecular mass of above one million. Examples thereof are the polymers obtainable under the names Carbopol 940 and 941.

The carrier material is preferably free of strongly alkaline constituents. Particular preference is given to preparing the inventive granules using water-soluble carrier materials, for example sodium carbonate or sodium sulfate.

In the inventive granules, there are generally from 1 to 90% by weight, preferably from 10 to 80% by weight, more preferably from 20 to 70% by weight, of carrier material based on the finished surfactant compound.

In a particular embodiment, the abovementioned carrier materials may also be used as powdering agents for compounds composed of alcohol alkoxylates.

In addition, the inventive surfactant compounds may also comprise customary assistants, especially binders and/or granulating assistants.

Useful binders are cellulose and starch, and also ethers or esters thereof, for example carboxymethylcellulose (CMC), methylcellulose (MC) or hydroxyethylcellulose (HEC) and the corresponding starch derivatives, but also film-forming polymers, for example polyacrylic acids and copolymers of maleic anhydride and acrylic acid, and also the salts of these polymeric acids. Commercial products are, for example, Sokalan® CP 5 or 45.

The binders and granulating assistants used may also be surfactants, especially anionic and nonionic surfactants, surfactant compounds, di- and polysaccharides, cyclodextrins, meltable polyesters, polyalkylene glycols, especially polyethylene glycols, polypropylene glycols, more preferably polyethylene glycols having molecular weights of from 1000 to 10 000, preferably from 3000 to 6000, more preferably 4000, fatty acids, especially saturated fatty acids such as lauric acid, myristic acid, palmitic acid, stearic acid, hydrogenated erucic acid and behenic acid, and also especially mixtures derived from natural fatty acids, for example coconut, palm kernel or tallow fatty acids, soaps, especially saturated fatty acid soaps and waxes.

Preferred anionic surfactants are alkali metal salts, ammonium salts, amine salts and salts of amino alcohols of the following compounds: alkyl sulfates, alkyl ether sulfates, alkylamide sulfates and ether sulfates, alkylaryl polyether sulfates, monoglyceride sulfates, alkanesulfonates, α-olefinsulfonates, alkylarylsulfonates, arylsulfonates, especially cumenesulfonate, xylenesulfonate, toluenesulfonate, alkylamidesulfonates, alkyl sulfosuccinates, alkyl ether sulfosuccinates, alkylamide sulfosuccinates, alkyl sulfoacetates, alkylpolyglycerol carboxylates, alkyl phosphates, alkyl ether phosphates, alkyl sarcosinates, alkyl polypeptidates, alkylamido polypeptidates, alkyl isethionates, alkyltaurates, alkylpolyglycol ether carboxylic acids or fatty acids such as oleic acid, ricinoleic acid, palmitic acid, stearic acid, copra oil acid salt or hydrogenated copra oil acid salt. The alkyl radical of all of these compounds contains normally 8–32, preferably 8–22, carbon atoms.

Useful nonionic surfactants include polyethoxylated, polypropoxylated and polyglycerolated fatty acid alkyl esters, polyethyloxylated esters of fatty acids and of sorbitol, polyethoxylated or polyhydroxy fatty acid amides, preferably those of the formula $R_2$—CO—N($R_3$)—Z in which $R_2$CO is an aliphatic acyl radical having from 6 to 22 carbon atoms, $R_3$ is hydrogen, an alkyl or hydroxyalkyl radical having from 1 to 4 carbon atoms and Z is a linear or branched polyhydroxyalkyl radical having from 3 to 10 carbon atoms and from 3 to 10 hydroxyl groups, but also alkylglycosides of the general formula $RO(G)_x$ where R is a primary straight-chain or methyl-branched, especially 2-methyl-branched, aliphatic radical having from 8 to 22, preferably from 12 to 18, carbon atoms, and G is a glycose unit having 5 or 6 carbon atoms, preferably glucose. The degree of oligomerization x which reports the distribution of monoglycosides and oligoglycosides is preferably a number between 1 and 10; x is more preferably between 1.2 and 1.4.

The amount of assistant, likewise based on the finished surfactant compound, may be from 0 to 45% by weight, preferably from 2 to 20% by weight.

The components can be mixed in customary, batchwise or continuous mixing apparatus which are generally equipped with rotating mixer units, for example in a Lödige plowshare mixer, or Eirich intensive mixer.

The mixing times are preferably from 0.5 s to 20 min, more preferably from 2 s to 8 min.

In the mixing, all mixing variants are conceivable which ensure sufficient mixing of components a) to d). In a preferred embodiment, components a) to d) are mixed simultaneously. However, multistage mixing processes are also conceivable in which the individual components are introduced into the overall mixture individually in different combinations or together with other additives. In this specific case, it may be necessary to introduce certain components of the mixture, for example binders, into the process in the form of a melt.

In a preferred embodiment, a binder activatable by water, for example tyloses, celluloses, is mixed into the pulverulent mixture. After preparation of the mixture of all components, the latter is sprayed with water and mixed and subjected to a structural granulation in the mixer, for example in the plowshare mixer, annular bed mixer or intensive mixer. The water content in the mixture depends upon the formulation and may be, for example, from 5 to 50 percent by weight, preferably from 10 to 40 percent by weight, more preferably from 15 to 30 percent by weight (based on the overall mixture).

In a further embodiment, the resulting particulate product may be used to carry out a shaped granulation through dies in the extruder, but also through annular edge-runner presses, edge-runners, optionally with downstream spheronizer.

Downstream of the granulation, the moist product is dried, for which preference is given to using fluidized bed dryers. From the resulting granule, the coarse grain and fine grain fraction is removed by sieving. The coarse grain fraction is comminuted by grinding and, just like the fine grain fraction, fed to a new granulation process. The particle size of the granule prepared in this way is generally in the range of 50 μm–2000 μm, preferably 100 μm–1600 μm, more preferably of 200–1000 μm. In a manner known per se, the inventive surfactant compounds may also be prepared as a powder. In this case, there is no granulation.

The surfactant compounds obtained in accordance with the invention are directly suitable for use in detergents. However, in a particularly preferred use, they may be provided with a coating by processes known per se. To this end, the granule is encapsulated with a film-forming substance in an additional step, which can considerably influence the product properties.

Suitable coating agents are all film-forming substances such as waxes, silicones, fatty acids, fatty alcohols, soaps, anionic surfactants, nonionic surfactants, cationic surfactants, anionic and cationic polymers, and also polyalkylene glycols.

Preference is given to using coating substances having a melting point of 30–100° C.

Examples thereof are:

$C_8$–$C_{31}$ fatty acids, for example lauric acid, myristic acid, stearic acid; $C_8$–$C_{31}$ fatty alcohols, polyethylene glycols having a molar mass of from 1000 to 50 000 g/mol; fatty alcohol polyalkoxylates having from 1 to 100 moles of EO; alkanesulfonates, alkylbenzenesulfonates, α-olefinsulfonates, alkyl sulfates, alkyl ether sulfates having $C_8$–$C_{31}$ hydrocarbon radicals, polymers, for example polyvinyl alcohols, waxes, for example montan waxes, paraffin waxes, ester waxes, polyolefin waxes, silicones.

Also present in the coating substance softening or melting in range from 30 to 100° C. may additionally be further substances which do not soften or melt in this range in dissolved or suspended form, for example homopolymers, copolymers or graft copolymers of unsaturated carboxylic acid and/or sulfonic acids and alkali metal salts thereof, cellulose ethers, starch, starch ethers, polyvinylpyrrolidone; mono- and polyhydric carboxylic acids, hydroxy carboxylic acids or ether carboxylic acids having from 3 to 8 carbon atoms and salts thereof; silicates, carbonates, bicarbonates, sulfates, phosphates, phosphonates.

Depending on the desired properties of the coated granule, the contents of coating substance may be from 1 to 30% by weight, preferably from 5 to 15% by weight, based on the coated granule.

To apply the coating substances, mixers (mechanically induced fluidized bed) and fluidized bed apparatus (pneumatically induced fluidized bed) may be utilized. Possible mixers are, for example, plowshare mixers (continuous and batchwise), annular bed mixers or else Schugi mixers. When a mixer is used, the heating may be effected in a granule preheater and/or directly in the mixer and/or in a fluidized bed downstream of the mixer. To cool the coated granule, granule coolers or fluidized bed coolers may be used. In the case of a fluidized bed apparatus, the heating is effected via the hot gas used for fluidization. The granule coated by the fluidized bed process may, in a similar manner to the mixing process, be cooled via a granule cooler or a fluidized bed cooler. Both in the mixing process and in the fluidized bed process, the coating substance may be sprayed on via a one-substance or a two-substance nozzle apparatus.

The optional heating consists in a heat treatment at a temperature of from 30 to 100° C., but at or below a melting or softening temperature of the particular coating substance. Preference is given to working at a temperature which is just below the melting or softening temperature.

The inventive compounds feature good storage stability in pulverulent detergent and disinfectant formulations. They are ideal for use in heavy-duty detergents, stain removal salts, machine dishwashing rinse aids and pulverulent all-purpose cleaners.

The examples which follow are intended to illustrate the invention in detail without restricting it thereto.

EXAMPLE 1

$C_{12}/_{14}$ Fatty Alcohol Ethoxylate Compound

| | |
|---|---|
| Genapol ® LA 070 | 50.0% by weight |
| Sipernat ® 50S | 21.4% by weight |
| Sodium carbonate | 25.1% by weight |
| Tylose ® CR 1500 | 3.5% by weight |

Preparation

A laboratory plowshare mixer (Lödige M5) was initially charged with 347.1 g (=321.45 g of solid) of Sipernat 50S, 388.90 g (=376.05 g of solid) of sodium carbonate and 52.5 g of Tylose CR 1500 which were premixed at a mixer rotation rate of approx. 115 $min^{-1}$ for 1 min. Subsequently, the mixer rotation rate was increased to 220 $min^{-1}$ and 766.9 g (=750 g of solid) of Genapol LA 070 were introduced into the mixture within 4 min. To this premixture was added a total amount of water of 420 g and the mixture was stirred further for approx. 1 min, in the course of which granulation set in. The moist granule was discharged and dried at an air inlet temperature of 80° C. in a laboratory fluidized bed dryer (Retsch) for 15 min. Subsequently, the product was sieved in order to remove fine fractions of <200 μm and coarse fractions of >800 μm. This gave a 200–800 μm target yield of approx. 59%, a coarse fraction of approx. 28% and a fine fraction of approx. 13%. Grinding of the coarse material in a sieve mill and repeated sieving out between 200 and 800 μm allowed the overall target yield of the granule to be increased to approx. 80%.

EXAMPLE 2

$C_{12}/_{14}$ Fatty Alcohol Ethoxylate Compound

| | |
|---|---|
| Genapol ® LA 070 | 25.0% by weight |
| Sipernat ® 50S | 10.7% by weight |
| Sodium carbonate | 60.8% by weight |
| Tylose ® CR 1500 | 3.5% by weight |

Preparation

A laboratory plowshare mixer (Lödige M5) was initially charged with 173.49 g (=160.65 g of solid) of Sipernat 50S, 942.9 g (=911.85 g of solid) of sodium carbonate and 52.5 g of Tylose CR 1500 which were premixed at a mixer rotation rate of approx. 115 $min^{-1}$ for 1 min. Subsequently, the mixer rotation rate was increased to 220 $min^{-1}$ and 383.44 g (=375 g of solid) of Genapol LA 070 were introduced into the mixture within 4 min. To this premixture was added a total amount of water of 585 g and the mixture was stirred further for approx. 1 min, in the course of which granulation set in. The moist granule was discharged and dried at an air inlet temperature of 80° C. in a laboratory fluidized bed dryer (Retsch) for 15 min. Subsequently, the product was sieved in order to remove fine fractions of <200 μm and coarse fractions of >800 μm. This gave a 200–800 μm target yield of approx. 54%, a coarse fraction of approx. 40% and a fine fraction of approx. 6%. Grinding of the coarse material in a sieve mill and repeated sieving out between 200 and 800 μm allowed the overall target yield of the granule to be increased to approx. 79.5%.

Chem. designation of the commercial products used

| | |
|---|---|
| Genapol ® LA 070 (Clariant GmbH): | $C_{12}/_{14}$ fatty alcohol ethoxylate having 7 EO |
| Sipernat ® 50S (Degussa) | amorphous silica |
| Tylose ® Cr 1500 (Clariant GmbH) | carboxymethylcellulose, sodium salt. |

What is claimed is:

1. A free-flowing surfactant composition consisting of a) 30 to 80 weight percent of a nonionic surfactant consisting of fatty alcohol alkoxylate and optionally a compound selected from the group consisting of alkoxylated fatty acid alkyl ester, polyethoxylated sorbitol ester, polyethoxylated fatty acid amide, polyhydroxy fatty acid amide, alkylglycoside, and mixtures thereof, b) 10 to 30 weight percent amorphous silica having an internal surface area ranging from 450 to 500 $m^2/g$, c) a carrier material and d) 0 to 45 weight percent of an assistant, wherein a ratio of nonionic surfactant to amorphous silica ranges from 2:1 to 2.8:1.

2. The surfactant composition as claimed in claim 1, wherein the carrier material comprises from 1 to 90% by weight of the surfactant composition.

3. The surfactant composition as claimed in claim 1, wherein the carrier material comprises from 10 to 80% by weight of the surfactant composition.

4. The surfactant composition as claimed in claim 1, wherein The nonionic surfactant is an oxyethyiated $C_8$–$C_{22}$ fatty alcohol having from 1 to 80 EO units.

5. The surfactant composition as claimed in claim 1, wherein the carrier material comprises water-soluble carrier materials.

6. The surfactant composition as claimed in claim 1, wherein the assistant comprises binders, granulating assistants, and mixtures thereof.

7. A process for preparing the surfactant composition as claimed in claim 1, which comprises mixing components a), b), c) and, where present, d) and moistening this mixture, optionally granulating and drying.

8. A method for making a free-flowing solid detergent, said method comprising adding to the solid detergent the surfactant composition as claimed in claim 1.

9. A method for producing a solid surfactant granule, said method comprising:

a) mixing a surfactant composition consisting of:

i) 30 to 80 weight percent of a non-ionic surfactant consisting of fatty alcohol alkoxylate and optionally a compound selected from the group consisting of alkoxylated fatty acid alkyl ester, polyethoxylated sorbitol ester, polyethoxylated fatty acid amide, polyhydroxy fatty acid amide, alkylglycoside, and mixtures thereof;

ii) 5 to 40 weight percent of amorphous silica having an internal surface area ranging from 450 to 500 $m^2/g$;

iii) 1 to 90 weight percent of a carrier material, and iv) 0 to 45 weight percent of an assistant, to provide a mixture wherein a ratio of nonionic surfactant to the amorphous silica ranges from 2:1 to 2.8:1;

b) moistening the mixture to provide a water content of from 5 to 50 weight percent of the mixture;

c) granulating the mixture to provide said solid surfactant granule.

* * * * *